US006351916B2

(12) United States Patent
Militzer

(10) Patent No.: US 6,351,916 B2
(45) **Date of Patent: *Mar. 5, 2002**

(54) WALL SYSTEM, IN PARTICULAR EXHIBITION HALLS

(75) Inventor: Gottfried August Franz Militzer, Sonnenbuehl (DE)

(73) Assignee: MBA-Design & Display Produkt GmbH, Reutlingen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/146,146

(22) Filed: Sep. 3, 1998

(30) Foreign Application Priority Data

Dec. 24, 1997 (DE) ..... 197 57 905

(51) Int. Cl.[7] ..... E04B 2/82; F16S 3/06
(52) U.S. Cl. ..... 52/239; 52/238.1
(58) Field of Search ..... 52/36.1, 239, 582.1, 52/582.2, 578, 584.1, 238.1, 71, 241

(56) References Cited

U.S. PATENT DOCUMENTS 4,192,106 A * 3/1980 Hell ..... 52/239 X
4,625,483 A * 12/1986 Zacky et al. ..... 52/239
5,094,053 A * 3/1992 Militzer ..... 52/239 X
5,211,502 A * 5/1993 Upham-Hill ..... 52/239 X
5,242,241 A * 9/1993 Nelson ..... 403/381 X
5,347,778 A * 9/1994 Bray ..... 52/239
5,502,930 A * 4/1996 Burkette et al. ..... 52/239 X
5,687,859 A * 11/1997 Miller ..... 52/584.1 X

FOREIGN PATENT DOCUMENTS

DE 3408250 * 7/1984 ..... F16S/3/06
DE 42 35 249 A1 4/1994
DE 0675240 * 4/1995 ..... E04B/2/74

* cited by examiner

*Primary Examiner*—Carl D. Friedman
*Assistant Examiner*—Basil Katcheves
(74) *Attorney, Agent, or Firm*—Michael J. Striker

(57) ABSTRACT

A wall system for exhibition halls has a plurality of rigid wall elements each having two cover plates, profiles arranged between the cover plates on vertical edges for receiving of coupling elements, the profiles having a longitudinal groove with inwardly conical reducing cross-section, the longitudinal groove having side walls provided with oppositely located longitudinal grooves, the profile being provided with at least one opening arranged at one side selected from the group consisting of an upper end side and a lower end side for receiving a pin or a screw of mounting elements arranged on an edge of the wall element selected from the group consisting of an upper edge and a lower edge.

11 Claims, 13 Drawing Sheets

WALL SYSTEM, IN PARTICULAR EXHIBITION HALLS

BACKGROUND OF THE INVENTION

The present invention relates to a wall system, in particular for exhibition halls, with several rigid wall elements, which have two cover plates, with profiles arranged on the vertical edges between them for receiving of coupling elements, which have a longitudinal groove with an inwardly conically reducing cross-section, wherein the side walls of the longitudinal groove are provided with additional opposite longitudinal grooves.

Such a wall system is disclosed for example in the German patent application P 42 35 249.5 of the applicant. Coupling elements can be non-releasably anchored in the additional longitudinal grooves in the conical outer groove of the vertical edge profile of the wall element, and they are provided with an outer region corresponding to the shape of the groove. This facilitates mounting and dismounting of the wall system significantly, since the coupling elements are always coupled with one of two wall elements which are to be connected with one another.

In the known wall systems, however, the wall elements, in addition to the profiles extending on the vertical edges, also have a U-shaped profiles along the upper or lower edges, in which openings are provided for anchoring securing elements for the connection of two wall elements, or intermediate profiles are anchored between the individual wall elements. The production of the wall elements of the known wall systems therefore is relatively complicated. For introduction of the openings into the profiles on the upper and lower edges of the wall elements, additional working steps are needed.

SUMMARY OF THE INVENTION

Accordingly, it is an object of present invention to provide a wall system which is simplified for the production of individual wall elements as well as for the connection of several wall elements with one another.

In keeping with these objects and with one another which will become apparent hereinafter, one feature of present invention resides, briefly stated, in a wall system of the above mentioned type, in which the upper and/or lower end side of the edge profile, at least one opening for receiving of pins and/or screws of mounting elements arranged from the upper and/or lower edge of the wall element is provided.

In the inventive wall system the edge profile, in addition to the outer four coupling elements, simultaneously has one or several openings for anchoring of further connecting-or safety elements. Thereby in the inventive wall element the profile on the upper or lower edges of the wall elements is dispensed with. Also, a subsequent introduction of the openings into the wall elements is no longer necessary, since the prefabricated profiles for the vertical edges are already provided with such openings. Thereby both the production of individual wall elements and the connection of several wall elements with one another is simpler and less time consuming.

The profile end sides can extend at a distance to upper and lower edge of the wall element, so that the mounting elements inserted in the openings of the profile at least partially are covered by the cover plates of the wall elements. These features ensure for the manufacture of optically extremely satisfying walls. The connecting elements between the individual panels are similarly not visible. The pins of the mounting elements can be therefore screwable in the openings to obtain an especially reliable mounting. A simple plugging or arresting system is recommended.

The mounting elements can be formed for example as angular bodies with at least one pin insertable into the openings of the edge profile. Clamping or screw elements can be mountable on there angular bodies and engage the upper and lower edge of the mounting elements which abut against one another at an angle of 90°. The clamping or screw elements extends over the upper or lower edge of the mounting element. These elements can be plate-shaped and do not project beyond the plates. In the openings of the edge profile, however, the mounting elements can be formed as cover plates for intermediate profiles mountable between two wall elements. Such intermediate profiles provide for the arrangement of two or more wall elements at different angles relative to one another.

The intermediate profiles are anchored in the vertical edge profiles of the wall elements by coupling elements, and additionally secured by safety elements against release of the connection. The intermediate profiles can be formed for example in the form of tubular portions arranged within one another and limitedly turnable relative to one another, providing an arrangement of two wall elements at a variable angle of 0–90°. The outer pipe, in which the first of the wall elements is mounted, is provided for this purpose with one or several recesses through which the second wall element can be connected with the inner pipe. The desired angle between the wall elements can be therefore adjusted steplessly, and subsequently, by suitable features it can be fixed.

The intermediate profiles can however be composed of a multi-cornered cross-section for connecting of at least two wall elements arranged relative to one another at a fixed angle. The intermediate profile can be for example provided with a substantially triangular cross-section, and a wall element is anchorable on each of the side surfaces of the intermediate profile. When the cross-section of the profile is designed in the form of a unilateral and straight triangle, two wall elements can be arranged at an angle of 90° relative to one another and the third wall element can be arranged at an angle of 135° to the first two wall elements.

The intermediate profiles and the wall elements can be secured against a release of connection by web-shaped safety elements which are fixable in the openings of the profile and insertable as webs into recesses on the upper and/or lower end surfaces of the intermediate profile. Web-shaped safety elements can be angled or bent so as to provide the securing of the connecting points of the wall element arranged at different angles relative to one another.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
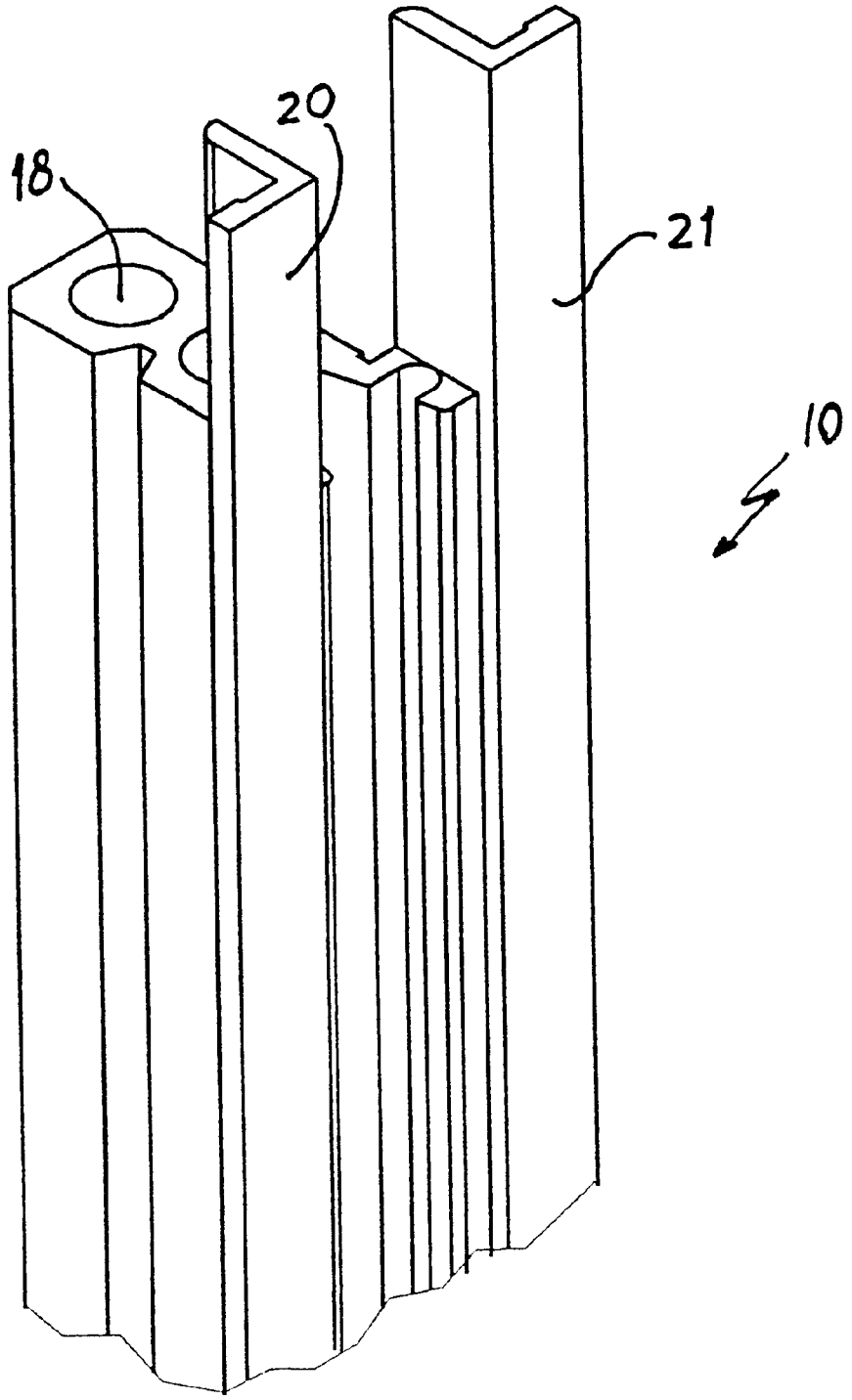
FIG. 1 is a perspective view of a first embodiment of an edge profile in accordance with the present invention.
Figure 3:
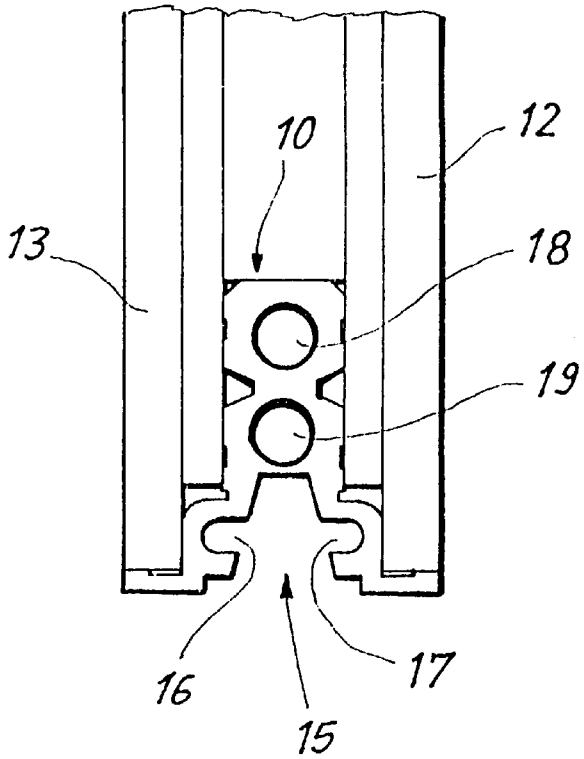
FIG. 3 is a view from above on the wall element of FIG. 2.
Figure 2:
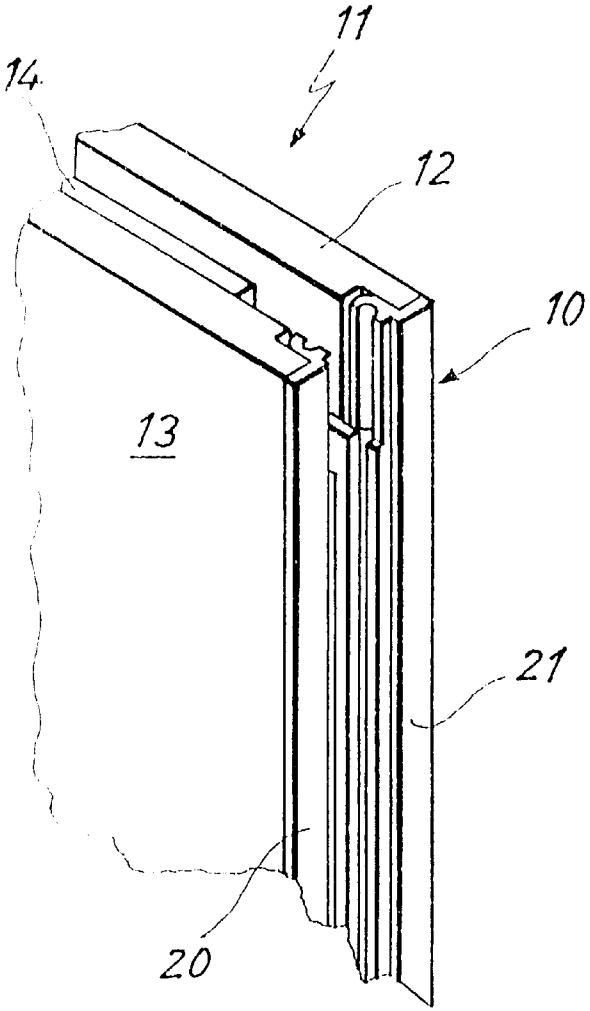
FIG. 2 is a perspective view of a wall element with the edge profile of FIG. 1.
Figure 6:
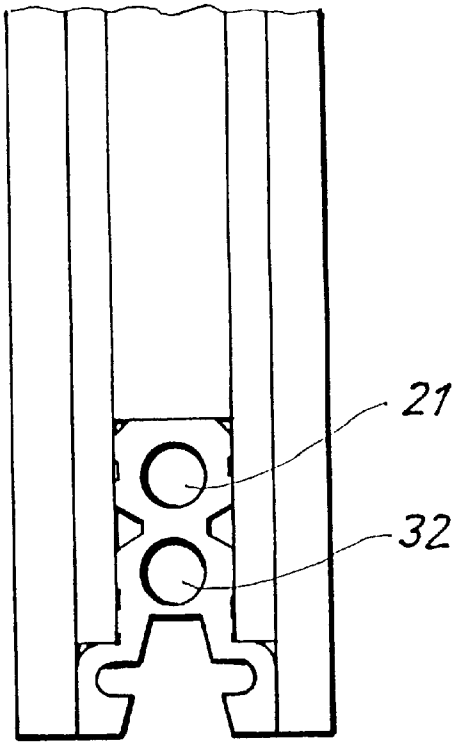
FIG. 6 is a view from above on the wall element of FIG. 5.

FIG. 1 shows a first edge profile 10 for a wall element 11 of FIG. 2. It is composed of two cover plates 12 and 13 and a honeycomb structure 14 located between them and not shown in detail. The edge profile 10, as can be seen in FIG. 2, is inserted between both cover plates 12 and 13. It has, as shown in FIG. 3, a longitudinal groove 15 with a lateral groove 16, 17 provided in its lateral walls at the opposite points. The grooves 16 and 17 serve for receiving of mounting elements for connecting of two neighboring wall points.

As can be seen from FIG. 2, the two side webs 20 and 21 of the edge profile 10 engage the end side of the cover plates 12 and 13 of the wall element 11. Moreover, the profile body of the edge profile 10 is provided with two openings 18 and 19 at the end side. In these openings additional mounting elements can be anchored. The end side of the edge profile 10 is set back relative to the upper edges of the cover-plates 12 and 13, so that the mounting elements which are anchored in the openings 18 and 19 no longer project outwardly beyond the upper edges of the plates 12 and 13.

Figure 5:
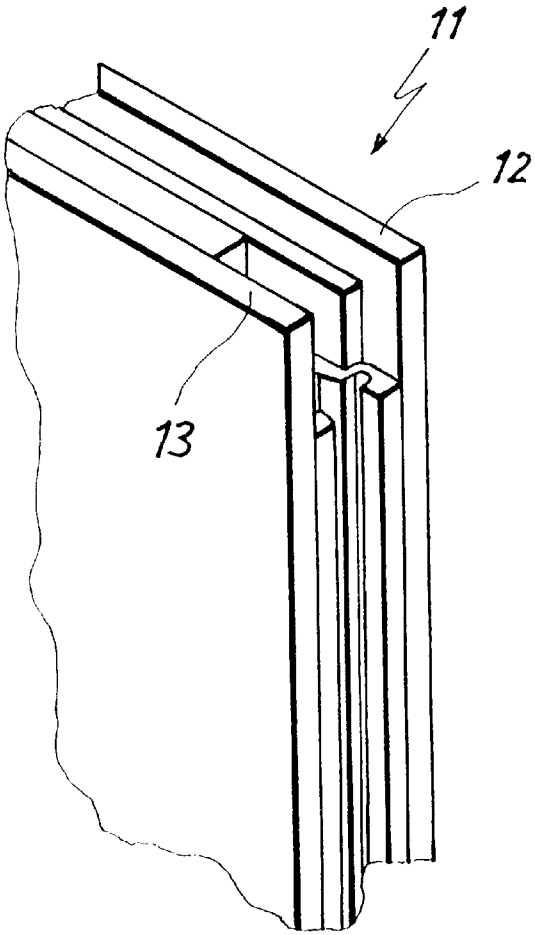
FIG. 5 is a perspective view of a wall element with an edge profile of FIG. 4.
Figure 4:
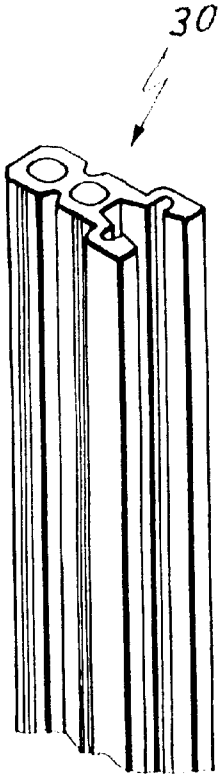
FIG. 4 is a perspective view of a second embodiment of an edge profile.

In contrast to FIGS. 1–3, FIGS. 4–6 show an edge profile 30 which after insertion in a wall element 11 shown in FIG. 5 does not engage the front end sides of the cover plates 12 and 13 of the wall element 11. Instead, it is connected flush with it. Regardless of this, the construction of the edge profile 30 is identical to the edge profile 10 of FIGS. 1–3.

Figure 7:
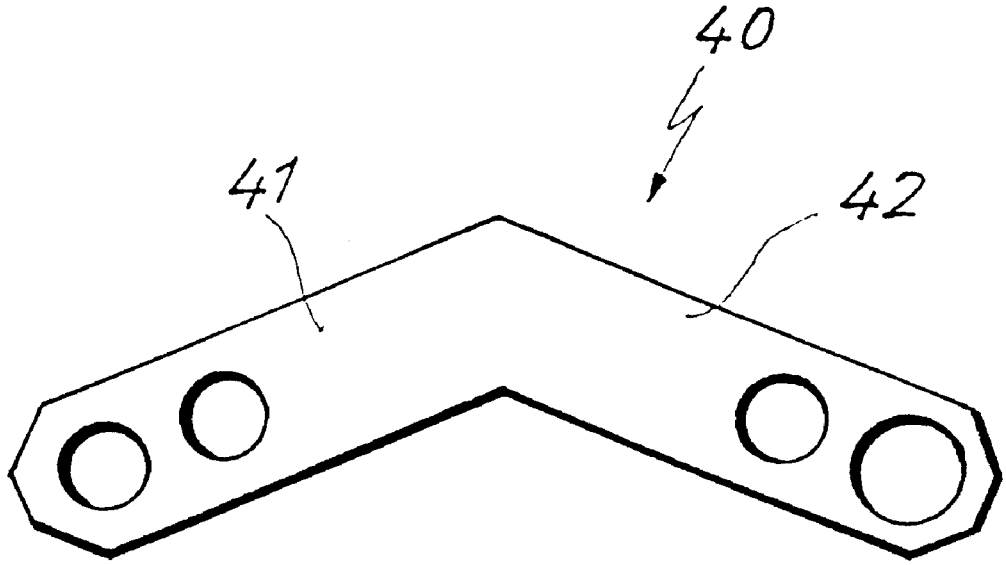
FIG. 7 is a view from above on a first mounting element for a connection of two wall elements arranged at an angle relative to one another.
Figure 8:
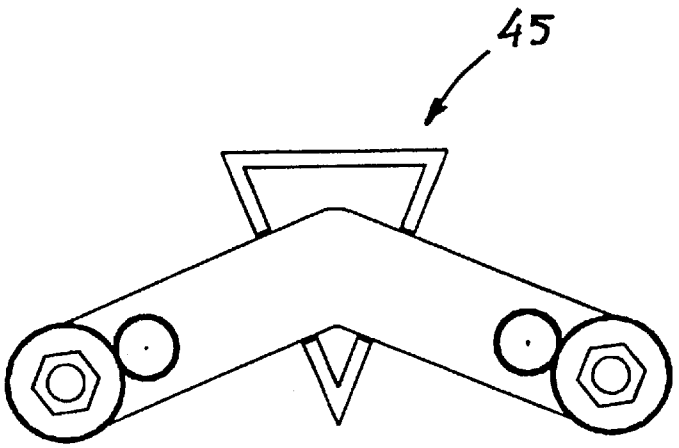
FIG. 8 is a view from above on the mounting element from FIG. 7 used in an intermediate profile for the wall element.
Figure 9:
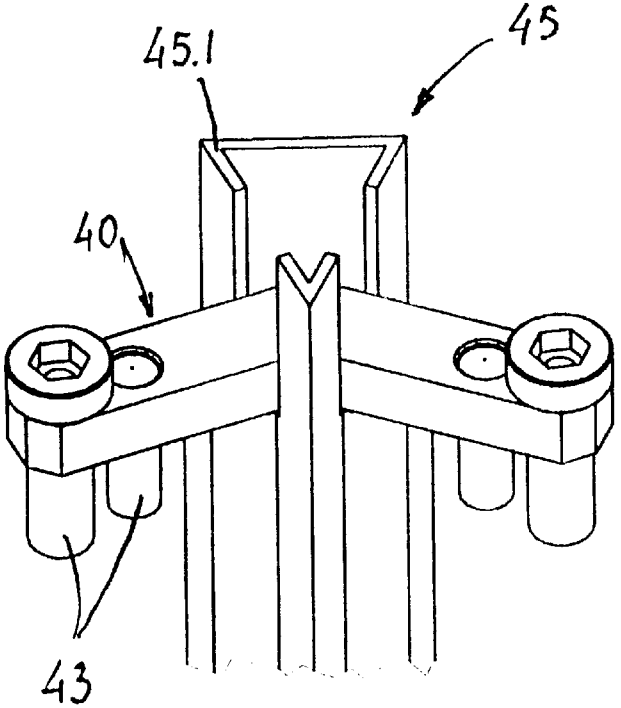
FIG. 9 is a side view of the intermediate profile of FIG. 8.
Figure 10A:
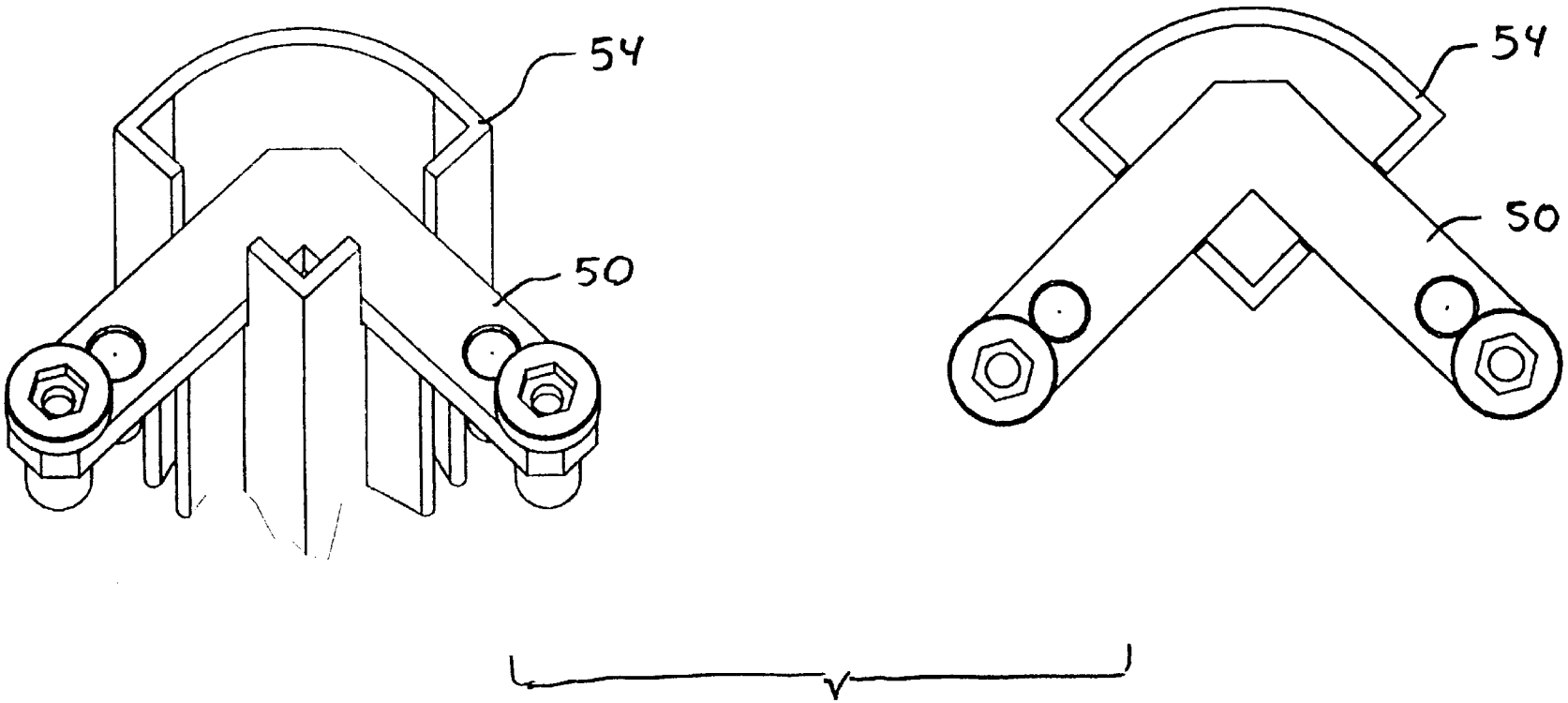
FIG. 10 are plan views of four further examples of mounting elements used in intermediate profiles.
Figure 10B:
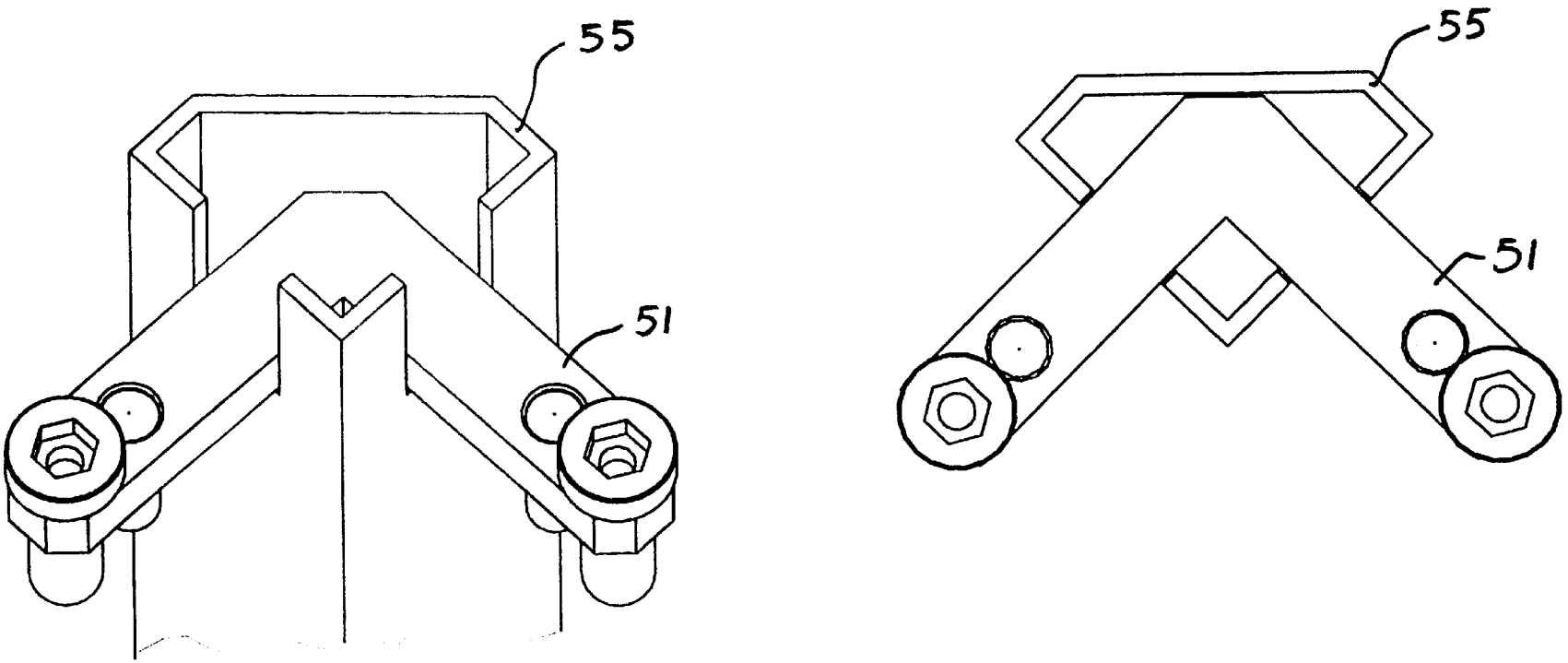
Figure 10C:
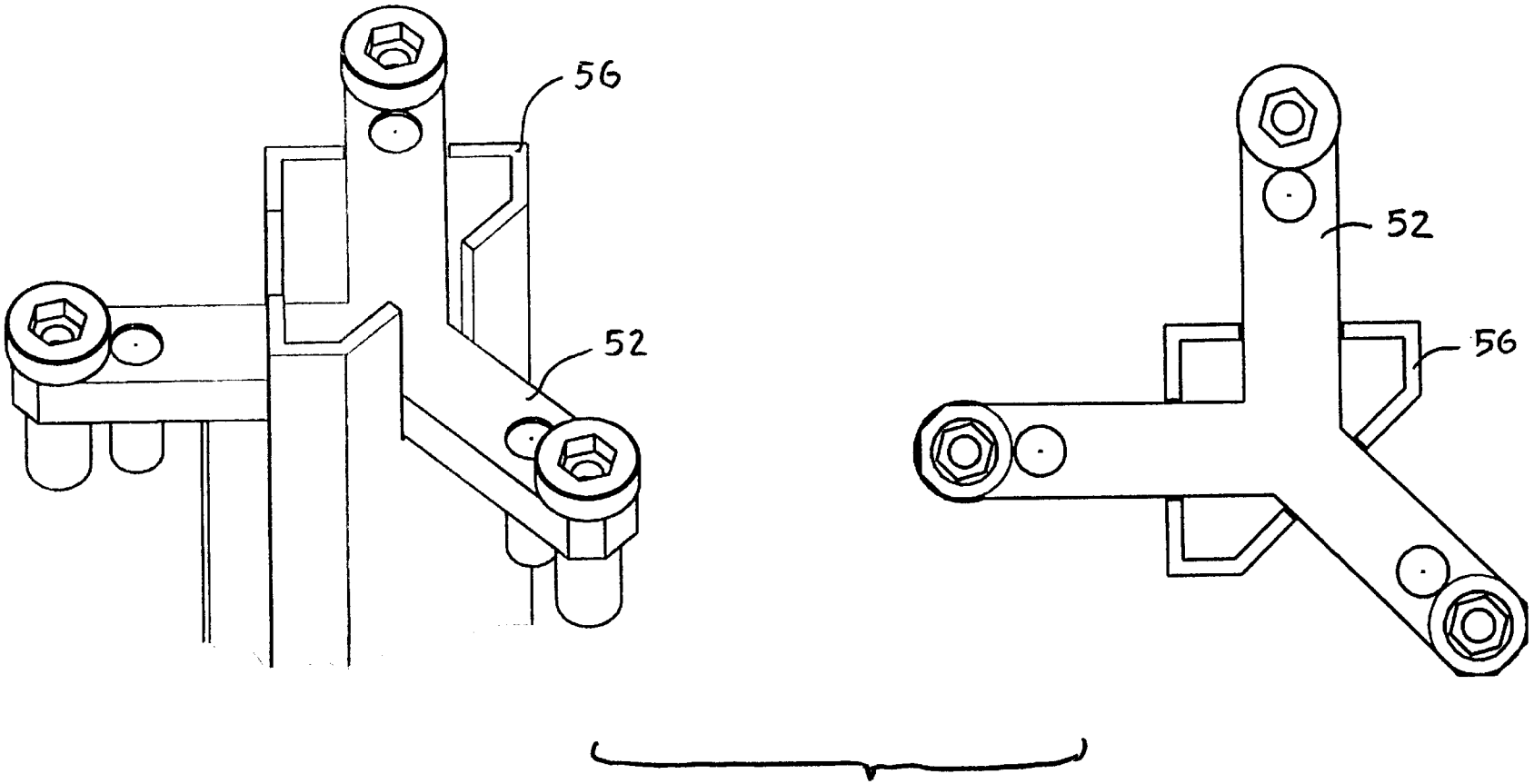
Figure 10D:
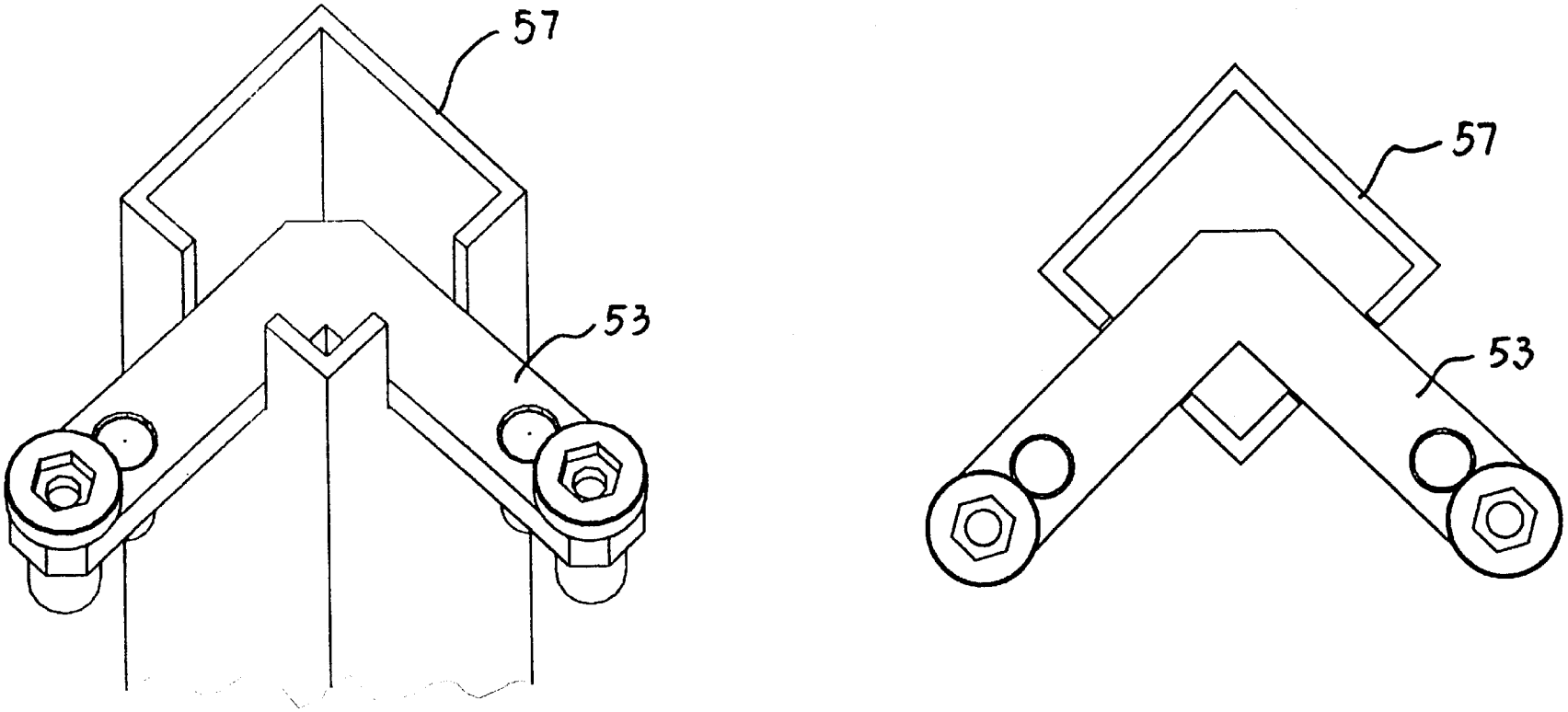
Figure 13:
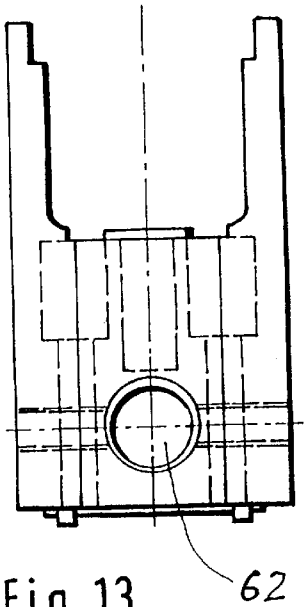
FIG. 13 is a view from the front of the corner region of FIG. 11.

FIG. 7 shows a first mounting element which is insertable in the openings 18, 19 or 31, 32 of the edge profile 10, 30. The mounting element 40 has two legs 41, 42 which abut against one another at an acute angle. Pins 43 shown in FIG. 9 are arranged on the ends of the legs 41, 42 and are insertable into openings 18, 19 or 31, 32. By means of the connecting element 40, two wall elements 11 can be connected with one another at an angle 135°. The thusly produced wedge-shaped intermediate space between the both wall elements can be filled by an intermediate profile 45, shown in FIG. 8 and having a corresponding shape.

An intermediate profile 45 can be anchored in the longitudinal groves of the edge profiles 10, 30. The mounting element 40 can be inserted in the recesses of the upper and/or lower end surfaces 45.1 of the intermediate profile 45 as shown in FIG. 9. FIG. 10 shows four further examples of mounting elements 50,51, 52, 53 and the intermediate profiles 54, 55, 56, 57 in which the mounting elements 50–53 are insertable. With these elements and intermediate profiles two, three or four wall elements can be connected with one another with different angular adjustments, and the operation and mounting of the elements 50, 53 and the profiles 54–57 correspond to those of the element 40 and the profile 45.

Figure 11:
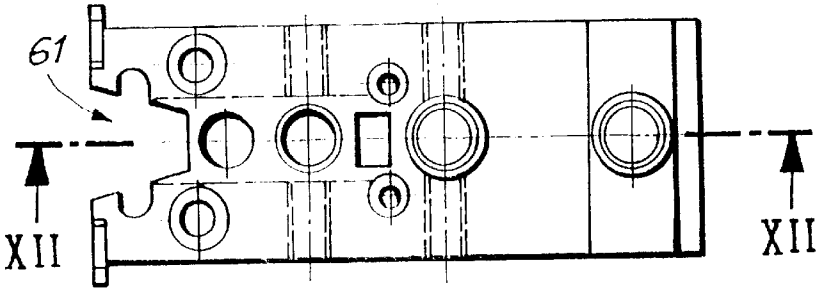
FIG. 11 is a view from above on the corner region of an edge profile.
Figure 12:
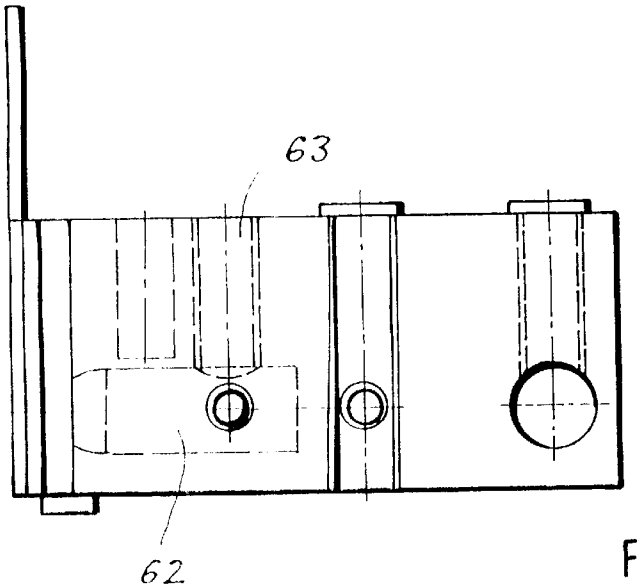
FIG. 12 is a longitudinal section taken along the line XII—XII through a corner region of FIG. 11.
Figure 14:
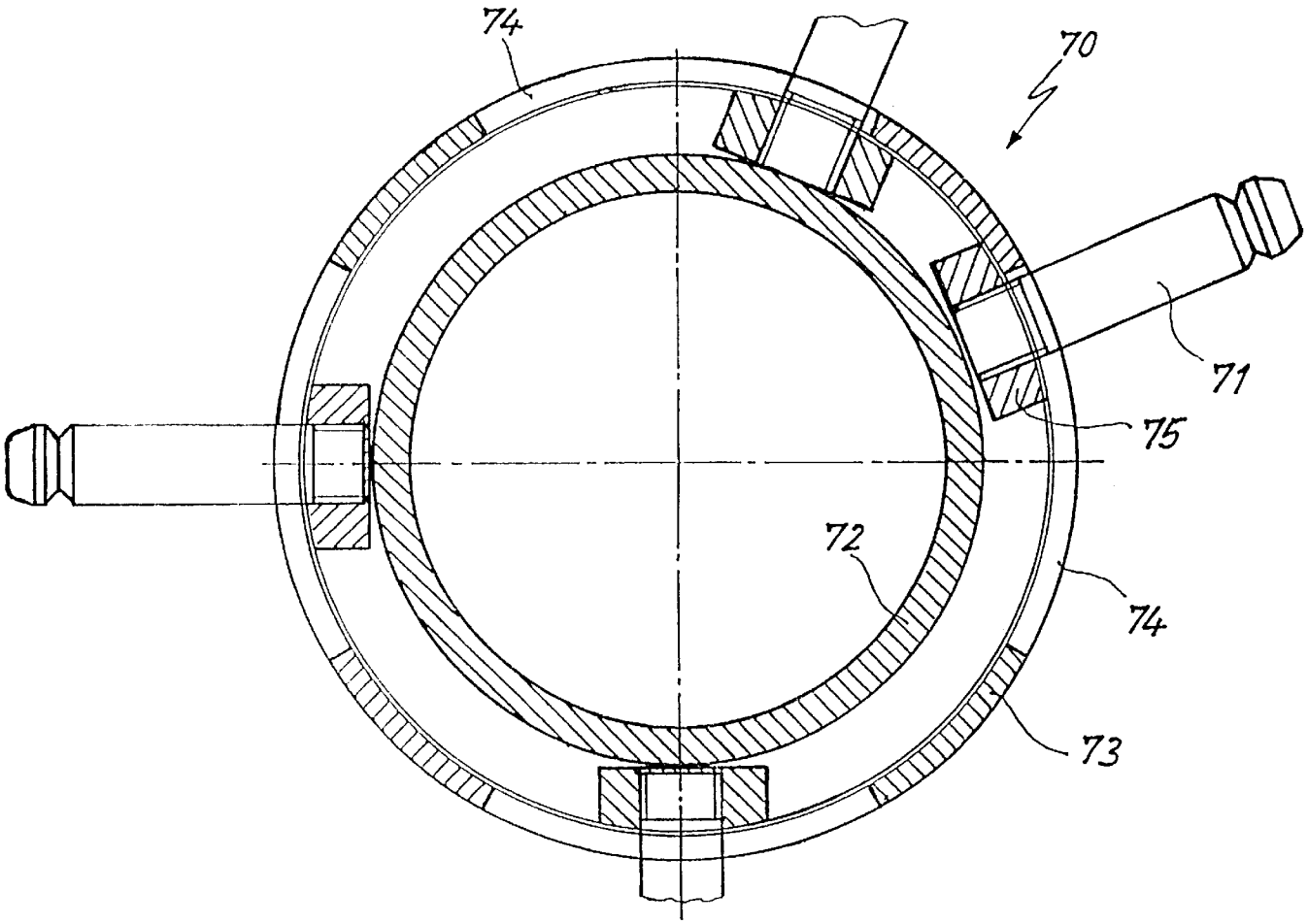
FIG. 14 is a cross-section through an intermediate profile with a circular cross-section.

FIG. 11 shows a plan view on a corner region of a further edge profile 60 which is provided on its upper side with several openings. As can be seen from the section of FIG. 12, a frontal opening 62 is arranged in the front longitudinal groove 61 shown in FIG. 11 of the profile 60. A transverse opening 63 extending from above opens into the opening 62. A pin or the like can be received in the frontal opening 62 and fixed by means of a screw or the like inserted through the opening 63. This makes possible for example the mounting of the wall elements on a round column 70 shown in FIG. 14, by means of a radial projecting pin 71. The round columns 70 are used when a multi-stark mounting of the wall system is needed. The round column 70 is composed of an inner tube 72 and an outer tube 73 provided with several recesses 74. The tubes 72 and 73 can turn relative to one another. Moreover, the pin 71 can be mounted at different points inside the recesses 74 by means of groove blocks 75, so that the wall elements on the round column 70 can be anchored in any angular position.

Figure 15:
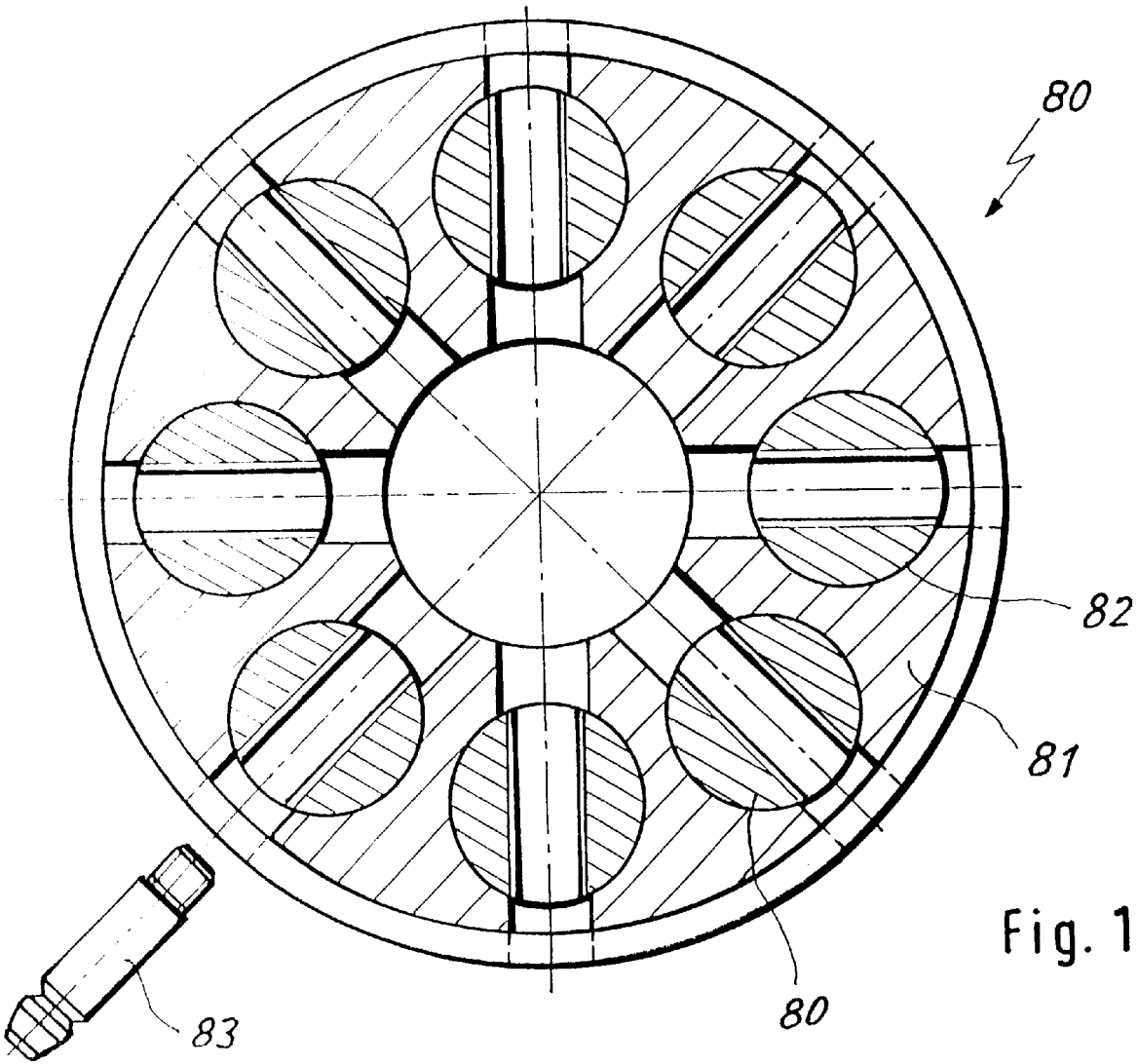
FIG. 15 is a cross-section through a second embodiment of an intermediate profile with a circular cross-section.

FIG. 15 shows a further embodiment of a round column 80. The round column 80 has an inwardly located bearing disc 81. It is provided with two freely movable, round individual inserts 82 operating with one hand for receiving of connecting pins 83 for the wall elements 11. The diameter of the column 80 is selectable freely. Also, the column 80 is suitable for anchoring of wall elements at elevated structures. As desired, any number of the inserts 82 can be provided and correspondingly many wall elements are connected with the column 80.

Figure 18:
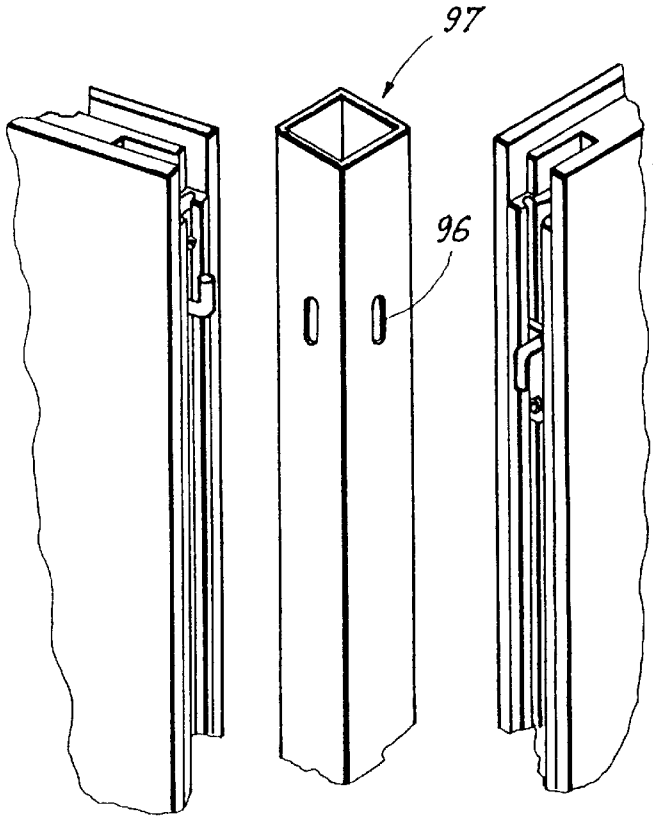
FIG. 18 is a perspective view of the edge regions of two wall elements with the mounting elements of FIG. 16 as well as with an intermediate profile.
Figure 17:
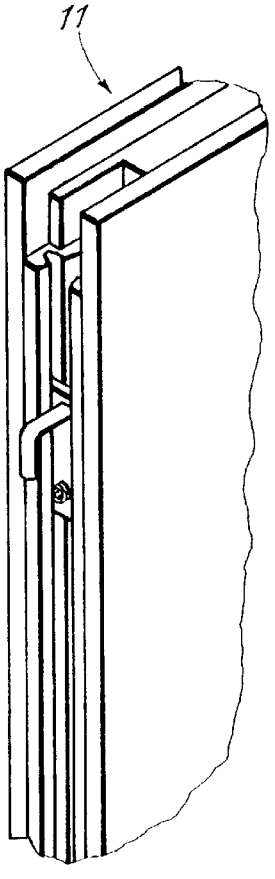
FIG. 17 is a perspective view of the edge regions of two wall elements with the mounting elements of FIG. 16.
Figure 17:
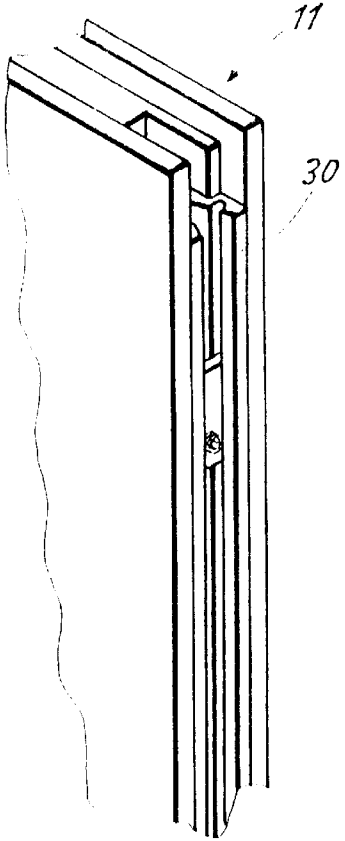
Figure 16A:
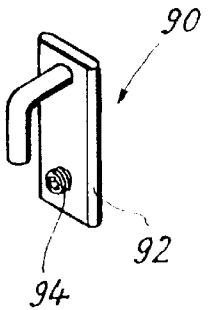
FIG. 16 is a view showing two plate-shaped mounting elements which are anchorable in the grooves of the edge profile.
Figure 16B:
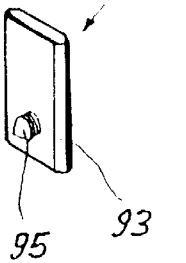

FIG. 16–18 show mounting elements 90 and 91 having a to plate-shaped base body 92, 93. Therefore they are insertable into the lateral grooves of an edge profile 10 or 30 of the wall elements 11 (FIGS. 17 and 18) and anchorable by clamping screws 94, 95. The elements 90, 91 can be suspended in one another or in longitudinal openings 96 of an intermediate profile 97 as shown in FIG. 18.

It will be understood that each of the elements described above, or two or more together, may also find a useful application in other types of constructions differing from the types described above.

While the invention has been illustrated and described as embodied in wall system, in particular for exhibition halls, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A wall system for exhibition halls, comprising a plurality of rigid wall elements each having two cover plates; profiles arranged between said cover plates for receiving coupling elements, said profiles having a longitudinal groove with inwardly conical reducing cross-section, said longitudinal groove having side walls provided with oppositely located longitudinal grooves, said profile being provided with at least one opening arranged at one side selected from the group consisting of an upper end side and a lower end side for receiving at least one pin or screw; and mounting elements arranged on an edge of the wall elements selected from the group consisting of an upper edge and a lower edge and each providable with said at least one pin or screw, said profile in a region of its end selected from the group consisting of an upper end and a lower end being provided with a frontal opening formed in said longitudinal groove, in which a transverse opening extending from upper or lower end side of said profile opens.

2. A wall system as defined in claim 1, where said pin of said mounting elements is screwable into at least one of said opening.

3. A wall system as defined in claim 1, wherein said wall elements have profile end sides which extend at a distance to an upper edge and a lower edge of said wall element.

4. A wall system as defined in claim 1, wherein said mounting elements are formed as angular bodies.

5. A wall system for exhibition halls, comprising a plurality of rigid wall elements each having two cover plates; profiles arranged between said cover plates for receiving coupling elements, said profiles having a longitudinal groove with inwardly conical reducing cross-section, said longitudinal groove having side walls provided with oppositely located longitudinal grooves, said profile being provided with at least one opening arranged at one side selected from the group consisting of an upper end side and a lower end side for receiving at least one pin or screw; and mounting elements arranged on an edge of the wall elements selected from the group consisting of an upper edge and a lower edge and each providable with said at least one pin or screw, said mounting elements being formed as angular bodies with said pin insertable into at least one said openings; and clamping elements connectable with said angular bodies and engaging an edge of said wall elements arranged at an angle of 90° relative to one another, which edge is selected from the group consisting of an upper edge and a lower edge.

6. A wall system for exhibition halls, comprising a plurality of rigid wall elements each having two cover plates; profiles arranged between said cover plates for receiving coupling elements, said profiles having a longitudinal groove with inwardly conical reducing cross-section, said longitudinal groove having side walls provided with oppositely located longitudinal grooves, said profile being provided with at least one opening arranged at one side selected from the group consisting of an upper end side and a lower end side for receiving at least one pin or screw; and mounting elements arranged on an edge of the wall elements selected from the group consisting of an upper edge and a lower edge and each providable with said at least one pin or screw, said mounting elements being formed as angular bodies with said pin insertable into each of said openings; and screw elements connectable with said angular bodies and engaging an edge of said wall elements arranged at an angle of 90° relative to one another, which edge is selected from the group consisting of an upper edge and a lower edge.

7. A wall system for exhibition halls, comprising a plurality of rigid wall elements each having two cover plates; profiles arranged between said cover plates for receiving coupling elements, said profiles having a longitudinal groove with inwardly conical reducing cross-section, said longitudinal groove having side walls provided with oppositely located longitudinal grooves, said profile being provided with at least one opening arranged at one side selected from the group consisting of an upper end side and a lower end side for receiving at least one pin or screw; and mounting elements arranged on an edge of the wall elements selected from the group consisting of an upper edge and a lower edge and each providable with said at least one pin or screw, each of mounting elements being formed as a cover plate arranged in said at least one opening of said profile; and intermediate profiles arranged between said two wall elements.

8. A wall system as defined in claim 7, wherein each of said intermediate profiles is formed by tubular portions which are turnably arranged relative to one another in order to make possible an arrangement of two of said wall elements at a variable angle relative to one another.

9. A wall system as defined in claim 7, wherein each of said intermediate profiles is a multi-cornered cross-section for connecting of at least two of said wall elements at a fixed angle relative to one another.

10. A wall system as defined in claim 9, wherein each of said intermediate profiles has a substantially triangular cross-section, one of said wall elements being anchorable in one of side surfaces of said intermediate profile.

11. A wall system as defined in claim 7, wherein said intermediate profiles and said wall elements are secured against releasing of a connection by mounting elements arranged in recesses on an end side of said intermediate profile fixable in said at least one opening of said profile.

* * * * *